US005335574A

United States Patent [19]

Matsunaga et al.

[11] Patent Number: 5,335,574

[45] Date of Patent: Aug. 9, 1994

[54] SELF PLAYING PIANO AND AN APPARATUS FOR AUTOMATIC PLAYING OF A PIANO

[75] Inventors: Hiroshi Matsunaga; Tetsusai Kondo, both of Shizuoka, Japan

[73] Assignee: Kabushiki Kaisha Kawai Gakki Seisakusho, Japan

[21] Appl. No.: 36,661

[22] Filed: Mar. 24, 1993

[30] Foreign Application Priority Data

Apr. 7, 1992 [JP] Japan ..... 4-113199
Apr. 14, 1992 [JP] Japan ..... 4-119569

[51] Int. Cl.[5] ..... G10F 1/02; G10F 5/00; G10G 3/04

[52] U.S. Cl. ..... 84/21; 84/23; 84/115; 84/462

[58] Field of Search ..... 84/601, 602, 609, 610, 84/626, 19, 21, 23, 115, 462

[56] References Cited

U.S. PATENT DOCUMENTS 5,131,306 7/1992 Yamamoto ..... 84/462

*Primary Examiner*—Stanley J. Witkowski
*Assistant Examiner*—H. Kim
*Attorney, Agent, or Firm*—Andrus, Sceales, Starke & Sawall

[57] ABSTRACT

An apparatus for automatic playing of a piano, the apparatus activating operation terminals in consonance with received play data to play music. The apparatus includes an input device for receiving play data, the play data including soft pedal event information and key event information. The apparatus also includes: a soft pedal history storage unit that, when the soft pedal event information is received from the input device, temporarily holds ON/OFF history of a soft pedal in consonance with the soft pedal event information; a converter that, when the key event information is received from the input device and the soft pedal history storage unit is storing an ON event for the soft pedal, performs a predetermined conversion of key depression force data that is included in the key event information; and a controller that controls the operation terminals in consonance with the key depression force data that has been converted by the converter.

4 Claims, 10 Drawing Sheets (NORMAL PLAYING)
FIG. 2A
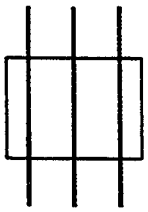
THREE STRINGS
FIG. 2B
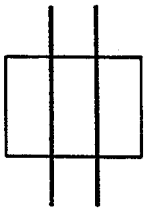
TWO STRINGS
FIG. 2C
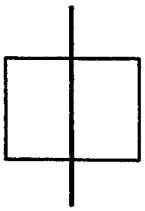
ONE STRING
(SOFT PLAYING)
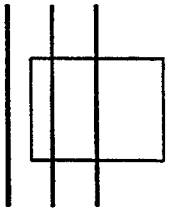
FIG. 2D
THREE STRINGS
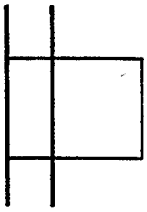
FIG. 2E
TWO STRINGS
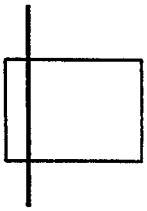
FIG. 2F
ONE STRING

| | KEY | PEDAL | CONTROL |
|---|---|---|---|
| IDENTIFICATION SYMBOL | 8 $*_H$ (NOTE OFF)<br>9 $*_H$ (NOTE ON ) | B 0 $_H$ | B 0 $_H$ |
| KEY NUMBER | 0 ( LOW )<br>∫<br>1 2 7 ( HIGH) | 4 3 $_H$ (SOFT PEDAL)<br>4 0 $_H$ (LOUD PEDAL) | 7 B $_H$<br>(ALL NOTE OFF ) |
| KEY DEPRESSION FORCE | 0 ( OFF )<br>1 ( LOW )<br>∫<br>1 2 7 ( HIGH) | 0 ( OFF )<br>1 (ON,<br>∫ OR INDICATES<br>1 2 7 PEDAL POSITION) | 0 0 $_H$ |
| TIME INFORMATION | EVENT EXECUTION TIME | SAME AS LEFT ENTRY | SAME AS LEFT ENTRY |

F I G. 4 B

SELF PLAYING PIANO AND AN APPARATUS FOR AUTOMATIC PLAYING OF A PIANO

BACKGROUND OF THE INVENTION

1. Field of the Invention

The present invention relates to self-playing pianos and control apparatuses for pianos that automatically play music on demand by manipulating piano keyboards and pedals in consonance with received play data. More particularly, the present invention relates to a technique for using the soft pedals of pianos to produce soft sounds.

Self-playing acoustic pianos, and apparatuses for automatically playing acoustic pianos, are in current, practical use. To play music, the drive mechanisms of these devices manipulate piano keyboards and pedals in consonance with prerecorded play data.

Automatic playing mechanisms are used with both upright pianos and grand pianos, but there is a big gap in the quality of the music obtained from these two instruments. The quality of the music produced by an upright piano is relatively poor, whether an automatic playing mechanism has been built in or has simply been attached. Thus, there is a demand for an upright piano with a built-in automatic playing mechanism, or for an automatic playing apparatus that can be attached to an upright piano, that can produce music comparable in quality to that produced by a grand piano.

2. Description of the Related Art

A conventional self-playing piano, or a conventional apparatus for automatic playing of a piano, incorporates a storage device,. e.g., a floppy disk, that holds play data, including key numbers, key depression force data and time information. When the piano or the apparatus receives a signal to begin playing, via, for example, an operation panel, it reads play data from the storage device and uses this data in its operation of the keyboard and pedals to perform automatic playing.

More specifically, play data constituting event information groups is previously stored in a storage device. As shown by the example in FIG. 4A, one event information group consists of an identification symbol, a key number, key depression force data, and time information.

When playing is initiated, one event information group of the play data is read from the storage device, and the included time information is examined. When the time information corresponds to an execution timing (time) for the read-out event information, procedures for this event information are performed, i.e., keys are depressed or released.

The execution time for an event information group is determined as follows: A time count, which is held by a time counter that counts clock cycles, is compared with the time information in the read-out event information group, and when they correspond it is assumed that the procedures for the event should be performed.

Then, the average electric power is determined, based on information designated in play data, that dictates how strongly, or at What key depression force, selected keys (key numbers) should be depressed, and then solenoids are driven using the determined electric power. Keys coupled to these solenoids are therefore depressed or released at a strength (velocity) relative to the average electric power, and predetermined dynamic music is played.

Unlike for key manipulation, key depression force data is not employed for the depression or release of pedals. Consonant with execution and time data, a constant strength is employed to manipulate pedals.

After the procedures for one event information group have been completed, the next event information group is read from the storage device and the described process is repeated. Music is produced by repeatedly reading and processing event information groups.

In general, acoustic pianos, either uprights or grands, have soft pedals and associated implementing mechanisms. When a soft pedal is depressed, its related mechanism is activated and produces a unique musical effect, hereafter referred to as the "soft sound effect."

The soft pedal mechanisms of current upright pianos and grand pianos differ both in structure and in effect.

More specifically, when the soft pedal of a grand piano is depressed, the keyboard action moves in a predetermined direction to alter the relative positions of the hammers and the strings. As a result, a sound that is produced by a hammer striking three strings while a soft pedal is at rest, for example, is produced by the hammer striking only two strings while the soft pedal is depressed. The soft sound effect obtained by depressing a soft pedal is clearly distinguishable.

On an upright piano, however, when the soft pedal is depressed a hammer rail that holds the hammers in their initial positions is moved in a predetermined direction to position the hammers one third closer to the strings than when the soft pedal is at rest. When, thereafter, hammers strike the strings a soft sound effect is obtained. This effect, however, actually has little aural appeal.

Since an automatic playing apparatus is designed to manipulate pedals and components using solenoids, the soft sound effect obtained is little different from that obtained when a player manually plays a piano.

Because, as described above, grand pianos and upright pianos are structurally different, the soft sound effects provided by them vary greatly. Specifically, the sound quality of grand pianos is far superior to that of upright pianos. When the same playing software is used to automatically play a grand piano and an upright piano, there is a distinct difference in the quality of the sounds that are produced.

On an upright piano, when the hammer rail that determines the positions of the hammers has greater momentum, and moves closer to the strings to enhance the soft sound effect provided by a soft pedal, the speed of its movement may cause the hammers to strike strings by accident and produce unwanted tones.

Because the soft sound effect of a self-playing upright piano has very little aural appeal, there are some self-playing pianos that do not have a soft pedal mechanism.

SUMMARY OF THE INVENTION

As described above, a conventional self-playing upright piano cannot provide a satisfactory soft sound effect using a soft pedal, and its sound quality is much poorer than that of a self-playing grand piano.

It is, therefore, an object of the present invention to provide a self-playing piano, and an apparatus for automatic playing of a piano, that can obtain the same soft sound effect upon depression of a soft pedal whether the piano in question is an upright piano or a grand piano, and that can improve the quality of the obtained sound if the piano in question is an upright piano.

To achieve the object of the present invention, a self-playing piano as described in claim 1, which activates operation terminals in consonance with received play data to play music, comprises:

input means for receiving play data, including, at the least, soft pedal event information and key event information;

soft pedal history holding means for, when the soft pedal event information is received from the input means, holding the ON/OFF history of a soft pedal in consonance with the soft pedal event information;

conversion means for, when the key event information is received from the input means and the soft pedal history holding means is holding an ON event for the soft pedal, performing a predetermined conversion of key depression force data that is included in the key event information; and control means for controlling the operation terminals in consonance with the key depression force data that has been converted by the conversion means.

To achieve the object described above, in addition to the arrangement described in claim 1, a self-playing piano as described in claim 2 comprises storage means for storing the play data, and input means for receiving the play data from the storage means.

To achieve the same object, an apparatus for automatic playing of a piano as described in claim 3, which activates operation terminals in consonance with received play data to play music, comprises:

input means for receiving play data, including, at the least, soft pedal event information for instructing an ON/OFF event of a soft pedal, and key event information for instructing the ON/OFF events of keys and for specifying key depression force;

soft pedal history holding means for, when the soft pedal event information is received from the input means, holding the ON/OFF history of the soft pedal in consonance with the soft pedal event information;

conversion means for, when the key event information is received from the input means and the soft pedal history holding means is holding an ON event for the soft pedal, performing a predetermined conversion of the key depression force data that is included in the key event information; and control means for controlling the operation terminals in consonance with the key depression force data that has been converted by the conversion means.

To achieve the above described object, an apparatus for automatic playing of a piano as described in claim 4, which activates operation terminals in consonance with received play data to play music, comprises:

storage means for storing play data, including, at the least, soft pedal event information for instructing an ON/OFF event of a soft pedal, and key event information for instructing the ON/OFF events of keys and for specifying key depression force;

soft pedal history holding means for, when the soft pedal event information is read from the storage means, holding the ON/OFF history of the soft pedal in consonance with the soft pedal event information;

conversion means for, when the key event information is read from the storage means and the soft pedal history holding means is holding an ON event for the soft pedal, performing a predetermined conversion of the key depression force data that is included in the key event information; and control means for controlling the operation terminals in consonance with the key depression force data that has been converted by the conversion means.

When the soft pedal of a piano is at rest and a key is depressed, its associated hammer strikes three strings in one key range (see FIG. 2A), two strings in another key range (see FIG. 2B), or one string in another key range (see FIG. 2C).

When the soft pedal of a grand piano is depressed, its hammers are displaced a predetermined distance laterally with respect to the strings. Thereafter, as shown in FIGS. 2D to 2F, a hammer that normally strikes three strings is so positioned that it will contact only two; a hammer that normally strikes two strings is so positioned that while it can strike both keys only its outer, lateral edge will contact one of them; and a hammer that normally strikes one string is so positioned that the point at which it will contact the string is near its outer, lateral edge.

As described above, a distinguishing characteristic of a grand piano is that to produce soft sounds within a specific key range it either reduces the number of strings that are struck or changes the hammer surface areas that strike strings. Sounds produced while the soft pedal is depressed are soft, but their accompanying soft sound effects vary in consonance with the key range.

The operational characteristic on which the present invention is based is the use of variable key depression force to obtain soft sound effects, for the several key ranges, comparable to those obtained by using a soft pedal.

More specifically, the invention in claim 1 has conversion means that converts key depression force data using a conversion property appropriate for a key range.

When play data received from input means includes soft pedal event information, soft pedal history holding means holds data indicating whether the soft pedal of the self-playing piano is in an ON or an OFF state.

Then, when key event information is received and the data held in the soft pedal history means indicates the state of the soft pedal is ON, conversion means is selected that has a conversion property appropriate for the key range to which a numbered key in the key information belongs.

Subsequently, key depression force data included in that key event information is converted by the selected conversion means to obtain new key depression force data. Based on this data, operation terminals are activated and keys are manipulated.

As described above, through a simple process, i.e., conversion of the key depression force data included in key event information, the same soft sound effect as that provided by depression of a soft pedal can be obtained.

Further, since conversion of key depression force data is performed in consonance with the key range to which a key number in key event information belongs, the soft sound effect that is produced following the depression of the soft pedal of a grand piano can be provided, and the sound quality obtained with an upright piano equals that obtained with a grand piano.

Also, as the soft sound effect is produced by controlling key depression force, rather than by mechanically depressing a soft pedal, the soft pedal driving mechanism can be eliminated, and a self-playing piano can be manufactured more easily, and at a lower cost.

In addition to all the means for the invention described in claim 1, the invention in claim 2 comprises storage means for storing play data, and performs automatic playing while reading play data from the storage means.

According to this invention, the effect described for the invention in claim 1 can be obtained, and automatic playing of a variety of music pieces is possible by changing the contents of the storage means.

The distinctive feature of claims 3 and 4 of the present invention is that the production of soft sound effects depends on the utilization of key depression force data, not on the manipulation of soft pedals.

More specifically, according to the invention in claim 3, when play data, received from, for example, an external device or a storage device, includes soft pedal event information, soft pedal history means holds the data that indicates the ON/OFF state of the soft pedal of the apparatus for automatic playing of a piano.

When key event information is received while the ON state of the soft pedal is held in the soft pedal history means, to depress a key a predetermined conversion of key depression force data included in the key event information is performed.

According to the invention in claim 4, soft pedal event information, as well as key event information, is pre-stored as play data in the storage means. When soft pedal event information is read from the storage means while automatic playing is performed in consonance with play data read from the storage means, the soft pedal history holding means holds data that indicates the ON/OFF state of the soft pedal of the apparatus for automatic playing of a piano.

When key event information is received while the ON state of the soft pedal is held in the soft pedal history holding means, to depress a key a predetermined conversion of the key depression force data included in the key event information is performed.

As described above, through a simple process, i.e., conversion of the key depression force data in key event information, the soft sound effect provided by depressing a soft pedal can be obtained.

Since control conversion parameters for key depression force data drastically affect the soft sound effect, this method is used for an upright piano to obtain sound quality that is equivalent to that of a grand piano.

Also, as the soft sound effect is not produced by actually using a soft pedal but only by controlling key depression force, a soft pedal driving mechanism can be eliminated and an apparatus for automatic playing of a piano can be manufactured more easily, and at a lower cost.

BRIEF DESCRIPTION OF THE DRAWINGS

FIGS. 2A–F are diagrams for explaining the mechanical principles of a self-playing piano according to the present invention;

FIGS. 4A and 4B are diagrams showing the contents of the event information that are used in the embodiments of the present invention;

DETAILED DESCRIPTION OF THE PREFERRED EMBODIMENTS

The preferred embodiments of a self-playing piano will now be described in detail while referring to the accompanying drawings. The present invention is applicable to either a self-playing piano for recording and reproduction or to a self-playing piano for reproduction. Since a configuration intended specifically for recording does not directly relate to the subject of the present invention, only a self-playing piano for reproduction that embodies the present invention will be explained.

Figure 1:
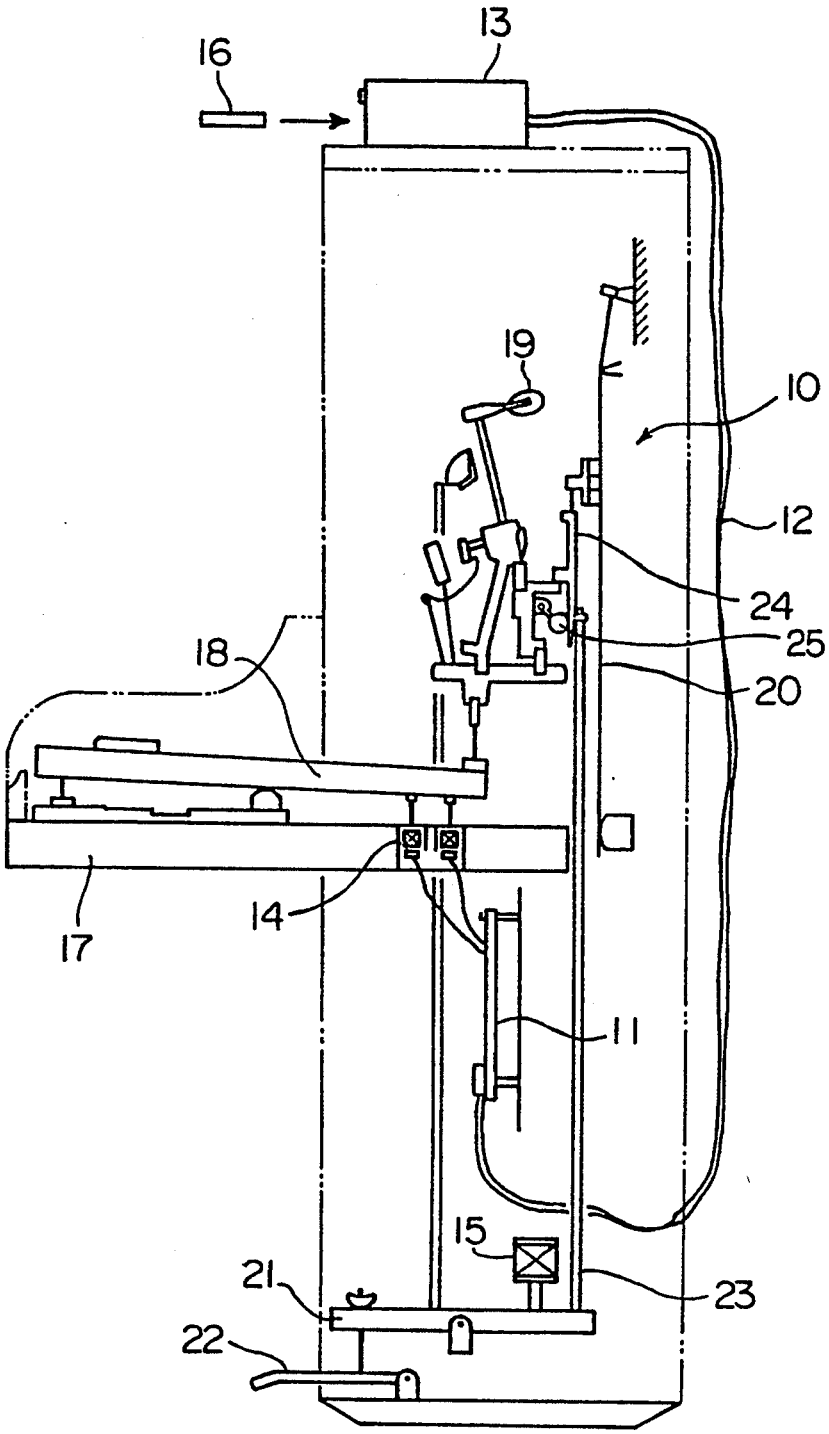
FIG. 1 is a partly simplified side view of the arrangement of a self-playing piano according to the present invention.

FIG. 1 is a partly simplified side view of the arrangement of one embodiment of a self-playing piano according to the present invention. Enclosed in a piano case 10 are various mechanical components peculiar to a functional piano, and others that are provided for the performance of the automatic playing function.

A piano may be broadly described as having three major functional divisions: a keyboard, actions, and pedals. As the arrangements and operations of these components are well known, only a general explanation of their construction and their functions will be given below.

Component parts of the keyboard and its related actions are a support 17, keys 18 that are arranged on the support 17, hammers that are rotated as a consequence of depression of the keys 18, strings 20 that are struck by the hammers 19, and dampers 24 that check the vibration (tone generation) of the strings when the keys 18 are released.

The support 17 is a fixed, structural component of the piano case 10. The keys 18 are pivotably supported near the center of their lengths by a fulcrum mounted on the support 17. The proximal ends of the keys 18 are coupled to driving mechanisms for the hammers 19 and to driving mechanisms for the dampers 24.

With such an arrangement, when the distal end of the key 18 in the figure is depressed, the key 18 pivots on the fulcrum mounted on the support 17 and its proximal end moves upward. This activates the driving mechanism for the hammer 19 which pivotably impels the hammer 19 toward the string 20. Concurrently, the driving mechanism for the damper 24 is activated and retracts the damper 24 from the string 20. As a result, the hammer 19 strikes the string 20 and a musical tone is produced.

When the distal end of the key 18 is released, the key 18 pivots on the fulcrum on the support 17 and its proximal end moves downward. As a consequence, the driving mechanism for the hammer 19 pivotably retracts the hammer 19 from the string 20, and the driving mechanism for the damper 24 concurrently brings the damper 24 into contact with the string 20. The vibrations of the string 20 are checked by the damper 24 and tone generation is halted.

The component parts of the pedals and their related actions are a loud pedal 22, a beam 21 that is coupled to the loud pedal 22, and a damper-lifting lever 23 that is coupled to the beam 21.

The proximal end of the loud pedal 22 is pivotably supported at the piano case 10 (fixed section). The loud pedal 22 is coupled near the center of its length to the outer end of the beam 21 by, for example, a shaft. The inner end of the beam 21 is attached to the lower end of the damper-lifting lever 23.

The damper-lifting lever 23 extends upward to the driving mechanisms for the dampers 24, and is coupled at its upper end to a damper rod 25. The damper rod 25 pivots on a rod hinge as the damper-lifting lever 23 is moved up and down. The position of the dampers 24 relative to the strings 20 is controlled by its movement.

With such an arrangement, when the loud pedal 22 is depressed, the outer end of the beam 21 that is coupled to the loud pedal 22 moves down. Consequently, the inner end of the beam 21 and the damper-lifting lever 23 are elevated, and the damper rod 25 that is coupled to the upper end of the damper-lifting lever 23 is pivoted upward to disengage the dampers 24 from the strings 20.

During this process, as the dampers 24 are disengaged from the strings 20 and vibration of the strings 20 is therefore not inhibited, when the key 18 is depressed, a loud, sustained musical tone is produced.

An apparatus for automatic playing of a piano according to the present invention electrically activates the piano keys 18 and the loud pedal 22 to perform automatic playing.

The automatic playing apparatus mainly comprises a circuit substrate 11, a cable 12, a controller 13, key solenoids 14, and a loud pedal solenoid 15.

The circuit substrate 11 is a substrate on which is formed an electric circuit to operate a piano. The circuit substrate 11 is attached to the piano case 10 at a predetermined position. The controller 13 is connected to the circuit substrate 11 by the cable 12, and the key solenoids 14 and the loud pedal solenoid 15 are connected to the circuit substrate 11 by power leads via which they receive predetermined drive signals. The arrangement of an electric circuit on the circuit substrate 11 will be described later while referring to FIG. 3.

The controller 13, an independent case, is mounted, for example, on the top of the piano case 10. The controller 13 includes an operation switch section 30, a display device 31, and a storage device 32 (see FIG. 3).

The operation switch section 30 consists of various switches for control of the piano. These switches (none of which are shown) are a volume control terminal to control volume, a start switch to instruct the start of automatic playing, a tempo switch to instruct a tempo, etc. The operational states of the individual switches in the operation switch section 30 are sent to the circuit substrate 11 via the cable 12.

The display device 31, constituted by, for example, an LCD (Liquid Crystal Display), is used to display operational conditions of the apparatus, and messages. For example, when automatic playing is begun, the display device 31 is used to display playing duration. The display device 31 is controlled in consonance with data that is sent from the circuit substrate 11 via the cable 12.

The storage device 32 is constituted by, for example, a floppy disk device. A floppy disk 16 on which is recorded play data (which will be described in detail later) is loaded into the storage device 32. The play data held by the floppy disk 16 is read by the storage device 32 and is sent via the cable 12 to the circuit substrate 11 for tone generation.

The key solenoids 14 are mounted in recesses that are provided at predetermined locations along the support 17. The movable portions of the key solenoids 14 are coupled to the proximal ends of the keys 18. When a key-ON control signal is transmitted from the circuit substrate 11, the movable portions of the key solenoids 14 are extended and push the proximal ends of the keys 18 upward.

The loud pedal solenoid 15 is mounted in a predetermined location on the piano case 10. The movable portion of the loud pedal solenoid 15 is secured to the rear section of the beam 21 (the end opposite to that coupled to the loud pedal 22). When a loud pedal-ON control signal is transmitted from the circuit substrate 11, the movable portion of the loud pedal solenoid 15 is retracted and the damper-lifting lever 23 is elevated.

With the above described structure, automatic playing processing will now be explained.

First, the floppy disk 16 on which play data is recorded is loaded into the storage device (floppy disk device) 32 that is included in the controller 13, and the start switch in the operation switch section 30 is depressed.

Then, play data recorded on the floppy disk 16 is sequentially read out and transmitted to the circuit substrate 11 via the cable 12. Upon receipt of the play data, a drive signal is produced in the circuit substrate 11 for each of the key solenoids 14, or for the loud pedal solenoid 15, to activate it in consonance with the predetermined timing.

When the key solenoids 14 are activated, the movable portions of the key solenoids 14 push up the proximal ends of the keys 18, thus placing the keys 18 in the same state as they would be were they depressed by a player. As the state of the keys 18 is being altered, concurrently the mechanisms for the hammers 19 are activated to pivotably impel the hammers 19 toward the strings 20, and the driving mechanisms for the dampers 24 are activated to retract the dampers 24 from the strings 20. Thereafter, when the hammers 19 strike the strings 20 musical tones are produced.

When the key solenoids 14 are inactivated, the movable portions of the key solenoids 14 return to their original positions, and the keys 18 are reset and placed in the same state as they would be were they released by a player. As the keys 18 are being reset, concurrently the driving mechanisms for the hammers 19 pivot the hammers 19 away from the strings 20, the driving mechanisms for the dampers 24 move the dampers 24 into contact with the strings 20, the dampers 24 check the vibrations of the strings 20, and tone generation is halted.

Tone generation by activating the keys 18 and tone generation halt by inactivating the keys 18 are performed in consonance with key numbers, key depression force, and time information, which are included in play data, and a specified musical piece is thus played.

When the loud pedal solenoid 15 is activated, its movable portion is retracted and the inner end of the beam 21 and the damper-lifting lever 23 are elevated. This process provides the same state as would the depression of the loud pedal 22 by a player.

More specifically, as the damper-lifting lever 23 rises, the damper rod 25 that is coupled to its upper end is pivoted upward and causes the damper lever to retract the dampers 24 from the strings 20. Since the dampers 24 do not contact the strings 20 and do not inhibit their vibration, when a key 18 is depressed, a loud, sustained musical tone, i.e., the loud pedal effect, is produced.

When the loud pedal 22 is released, the preceding process is inverted and the dampers 24 are returned to their normal positions in contact with the strings 20.

Figure 3:
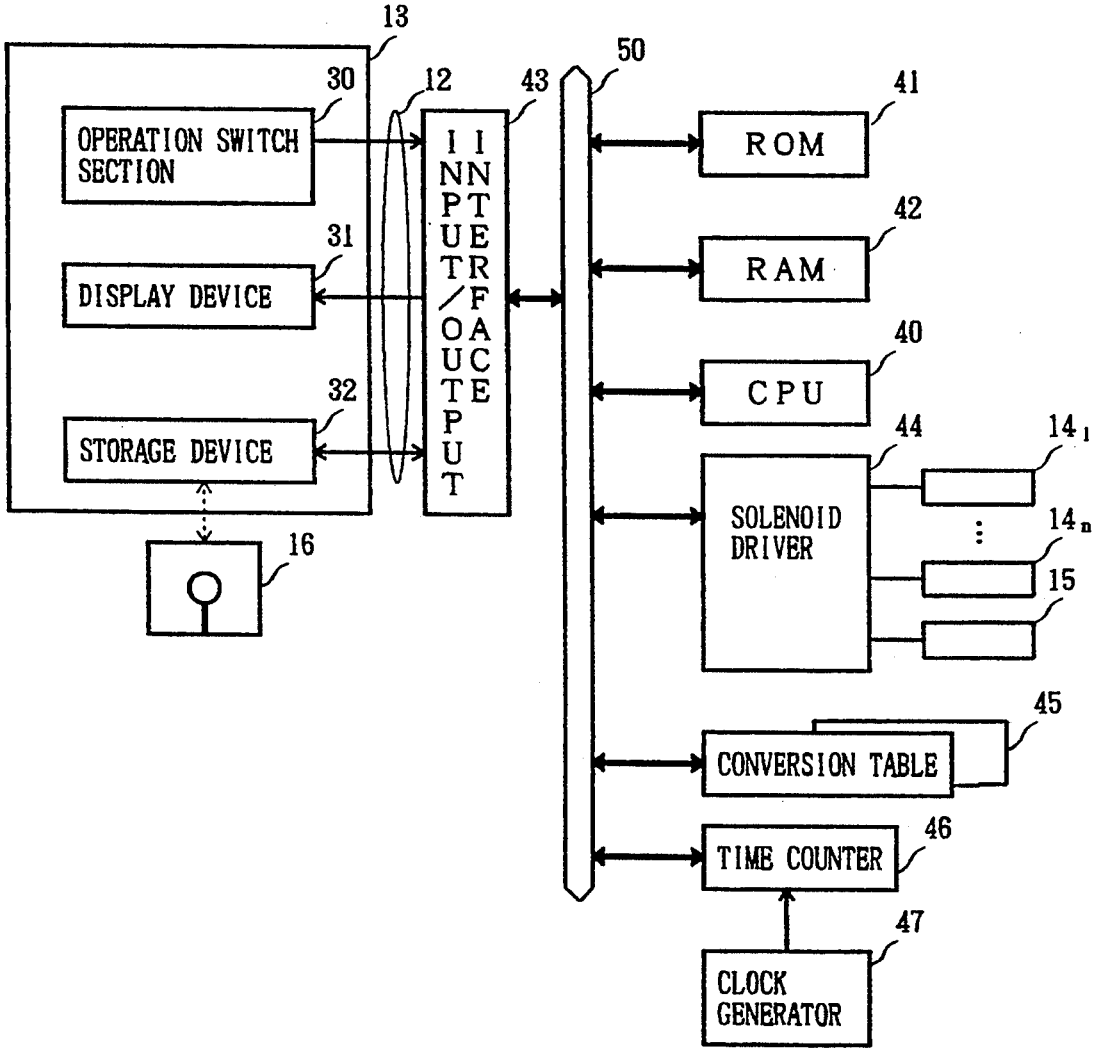
FIG. 3 is a schematic block diagram showing the arrangement of the electric circuits for both a self-playing piano and an apparatus for automatic playing of a piano according to embodiments of the present invention.

The preferred embodiments of the present invention will now be described in detail while referring to the accompanying drawings. FIG. 3 is a schematic block diagram illustrating the arrangement of one embodiment of a self-playing piano, and an apparatus for automatic playing of a piano, according to the present invention.

A central processing unit (CPU) 40 employs a control program that is stored in a read only memory (ROM) 41 to control the entire automatic playing apparatus. In addition to the above described control program, various data constants that the CPU 40 uses for specific processes are stored in the ROM 41. The ROM 41 is accessed by the CPU 40 through a system bus 50.

In a random access memory (RAM) 42, a work area for the CPU 40, and various registers and flags for controlling the automatic playing apparatus, etc. are defined. In the RAM 42, a soft pedal flag that is related to the distinctive feature of the present invention is defined, and the history of the ON/OFF states of the soft pedal 22 is stored. The RAM 42 is also accessed by the CPU 40 via the system bus 50.

One end of an input/output interface 43 is connected to the system bus 50, and the other end is connected to the controller 13 via the cable 12. The controller 13 includes the previously described operation switch section 30, the display device 31, and the storage device 32.

Switches provided on the operation switch section 30 (none of them shown) include a volume control terminal to control volume, a start switch to instruct the automatic playing start, and a tempo switch to instruct a tempo.

The switch ON/OFF states are detected by a scan circuit (not shown), and are sent via the cable 12 and the input/output interface 43 to the CPU 40. The switch ON/OFF data are stored in a predetermined area of the RAM 42 by the CPU 40.

The display device 31, constituted by, for example, an LCD, is used to display various operating conditions of the apparatus, and messages. For example, when automatic playing is begun, this display device 31 is used to display playing duration. The display device 31 is controlled in consonance with data that are transmitted from the CPU 40 via the input/output interface 43.

The storage device 32 is, for example, a floppy disk device wherein the floppy disk 16 that is utilized as a recording medium is loaded. The play data described above is recorded on the floppy disk 16.

Figure 4A:
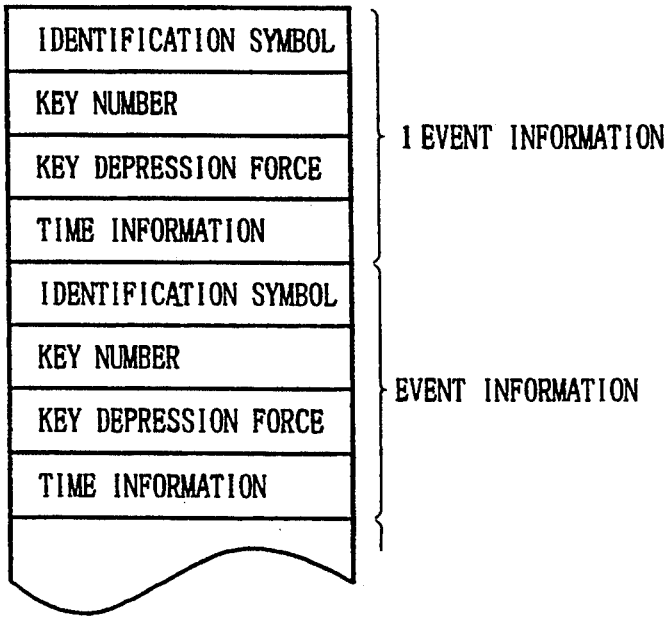

For the thus structured self-playing piano, play data consists of an event information group. As is shown in FIG. 4A, included in the event information group are an identification symbol, a key number, key depression force data, and time information.

Identification symbols are employed to represent specific types of event information. They are used, for example, to identify event information as key event information, pedal event information, or other control information.

If event information for a self-playing piano is key event information, for example, either numerical code "$8^*_H$" or "$9^*_H$" is used as an identification symbol (FIG. 4B). In these codes, the use of a subscripted H to denote the hexadecimal system, and the use of an asterisk (*) as a place holder for a variable numerical value conform to conventional usage and will be so employed hereinafter, as appropriate.

Identification symbol "$9^*_H$" represents note-ON key event information, i.e., event information for key depression. Identification symbol "$8^*_H$" represents note-OFF key event information, i.e., event information for key release.

When event information is pedal event or control information, code "$B0_H$" is used as an identification symbol. In this case, to determine whether event information is pedal event or control information a key number is examined.

With the identification symbols "$8^*_H$" and "$9^*_H$", which indicate key event information, a key number represents a numerically identified key where an event should be executed. With identification symbol "$B0_H$", key numbers "$43_H$" and "$40_H$" represent pedal event information, and key number "$7B_H$" represents control information.

The key number "$43_H$" indicates that the pedal event information is for a soft pedal, and the key number "$40_H$" indicates that it is for a loud pedal. For control information, the key number "$7B_H$" is used to identify information indicating that all notes are OFF.

For key event information, key depression force data are employed to designate a strength or a velocity for key depression or key release. A key depression force value of "$0_H$" represents key-OFF, and values of "$1_H$" to "$7F_H$" represent 127 different levels of key depression force. As will be described later, a predetermined conversion of the key depression force values is performed.

For pedal event information, a key depression force value of "$0_H$" represents pedal-OFF, and values of "$1_H$" to "$7F_H$" represent 127 different pedal positions. For control information, the key depression force value is always "$00_H$".

Time information is used to provide the timing (time) for the execution of event information. When a time information value corresponds to a count value held by the time counter 46, an event in consonance with the current event information is executed.

The play data that is read from the floppy disk 16, which is loaded into the storage device 32, is transmitted via the cable 12 and the input/output interface 43 to the CPU 40 and is used for automatic playing of a musical instrument.

The storage device for storing play data is not limited to the floppy disk 16; an event temporary register provided in an apparatus, such as an event memory or an FIFO (first-in-first-out memory) can be used as the storage device. And it is not always necessary to store play data inside the apparatus; it can instead be supplied by an external device.

A solenoid driver 44 drives the key solenoids $14_1$ to $14_n$ that are individually provided for the keys 18, and the loud pedal solenoid 15 that is provided for the loud pedal 22. As previously described, the key solenoids $14_1$ to $14_n$ are coupled to the keys 18, and the loud pedal solenoid 15 is coupled to the loud pedal 22.

Thus, when the CPU 40 activates the solenoid driver 44, the movable portions of the key solenoids $14_1$ to $14_n$ are elevated to lift the proximal ends of the keys 18, the movable portion of the loud pedal solenoid 15 is retracted to lift the damper-lifting lever 23, and key depression and pedal depression are performed.

When the CPU 40 signals the solenoid driver 44 to inactivate the key solenoids $14_1$ to $14_n$ and the loud pedal solenoid 15, release of the keys 18 and of the loud pedal 22 is accomplished.

As a soft pedal mechanism is not incorporated in this embodiment, a solenoid for driving a soft pedal is not therefore provided.

Conversion tables 45, constituted, for example, by a ROM, are used to convert key depression force data. Held in the conversion tables are data for converting given key depression force data to obtain the same soft sound effect as that obtained when a soft pedal is employed.

Figure 6:
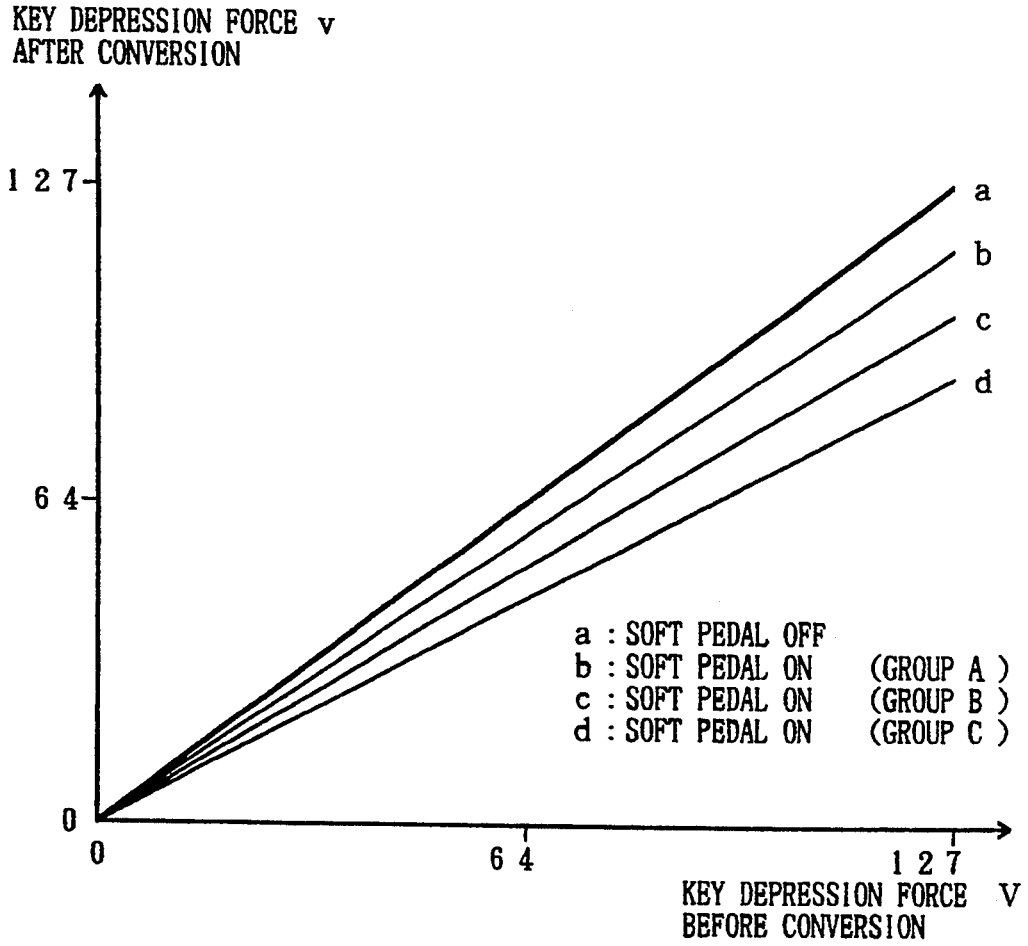
FIG. 6 is a graph for explaining the conversion characteristics of the conversion tables that are used in the embodiment of a self-playing piano according to the present invention.

As shown in FIG. 6, there are four different conversion table types. One type (represented by characteristic line "a") is used to convert key depression force data to obtain values that correspond to the soft pedal OFF state, and three other types (represented by characteristic lines "b" to "d") are used to convert key depression force data to obtain values that correspond to the soft pedal ON state. The horizontal graph line in FIG. 6 represents key depression force V before conversion and the vertical line represents key depression force v after conversion.

Each of the conversion tables 45, which are used for converting key depression force data to obtain values that correspond to the soft pedal ON state, holds conversion data for one of the groups (A, B, or C) that are identified in Table 1. In Table 1, each group corresponds to a key range that is determined by the number of strings that are struck by the hammers 19 when the keys 18 are depressed.

TABLE 1

| Group | Strings to be struck | Characteristic | Characteristic line in FIG. 6 |
|---|---|---|---|
| A | one | key depression force 5% down | characteristic line b |
| B | two | key depression force 10% down | characteristic line c |
| C | three | key depression force 15% down | characteristic line d |

Characteristic line "a" in FIG. 6 represents a conversion rate (rate of increase in key depression force v after conversion with respect to the increase in key depression force V before conversion) of "1". This indicates that there is no substantial conversion and that music is played normally, as it would be were no conversion of key depression force data performed.

Characteristic line "b" represents a conversion rate of 95%; characteristic line "c", one of 90%; and characteristic line "d", one of 85%. When the playing condition corresponds to a soft pedal ON state, key depression force data is converted by employing the characteristic that is suitable for a key range.

For an apparatus for automatic playing of a piano, as shown in FIG. 4B, identification symbol "$B0_H$" is used to identify pedal event information, which is the distinctive feature of the present invention. In the code, the subscripted H denotes the hexadecimal system, and will be so employed hereinafter, as appropriate.

When the identification symbol represents key event information, a key number is used to identify the key where an event should be executed. When the identification symbol represents pedal event information, key number "$43_H$" is used to represent soft pedal information, which is related to the distinctive feature of the present invention, and "$40_H$" is used to represent loud pedal event information.

Key depression force data designates a strength or velocity for key depression or key release when an ON event or an OFF event is executed. A key depression force value of "$0_H$" represents key-OFF, and values of "$1_H$" to "$7F_H$" represent 127 different levels of key depression force. A predetermined conversion of the key depression force data is performed as will be described later.

Time information is used to indicate an execution timing (time) for event information. When a time information value corresponds to a count value held by the time counter 46, an event in consonance with event information is executed.

Play data, which is read from the floppy disk 16 loaded into the storage device 32, is transmitted via the cable 12 and the input/output interface 43 to the CPU 40, and is used for automatic playing of a musical instrument.

The storage device for storing play data is not limited to the floppy disk. An event temporary register provided in the apparatus, such as an event memory or an FIFO (first-in-first-out memory), can also be used. It is not always necessary to store play data inside the apparatus; it can instead be supplied by an external device.

A solenoid driver 44 drives solenoids $14_1$ to $14_n$ that are individually paired with the keys 18 and the loud pedal 22. The solenoids $14_1$ to $14_n$ are coupled to the keys 18 and the loud pedal 22. Key depression and pedal depression are performed when, in response to a signal from the CPU 40, the solenoid driver 44 activates the solenoids $14_1$ to $14_n$ and the corresponding keys 18 and the pedal 22 are depressed.

Key release is performed when, in response to a signal from the CPU 40, the solenoid driver 44 inactivates the solenoids $14_1$ to $14_n$.

As in this embodiment a soft pedal mechanism is not incorporated, none of the above described solenoids $14_1$ to $14_n$ is used to drive a soft pedal.

Conversion tables 45, constituted, for example, by a ROM, include a soft pedal table that is used to convert key depression force data to obtain the same soft sound effect as that obtained when a soft pedal is employed, and characteristic conversion tables that are used for compensating for the electrical-mechanical conversion characteristics of the solenoids $14_1$ to $14_n$.

Figure 9:
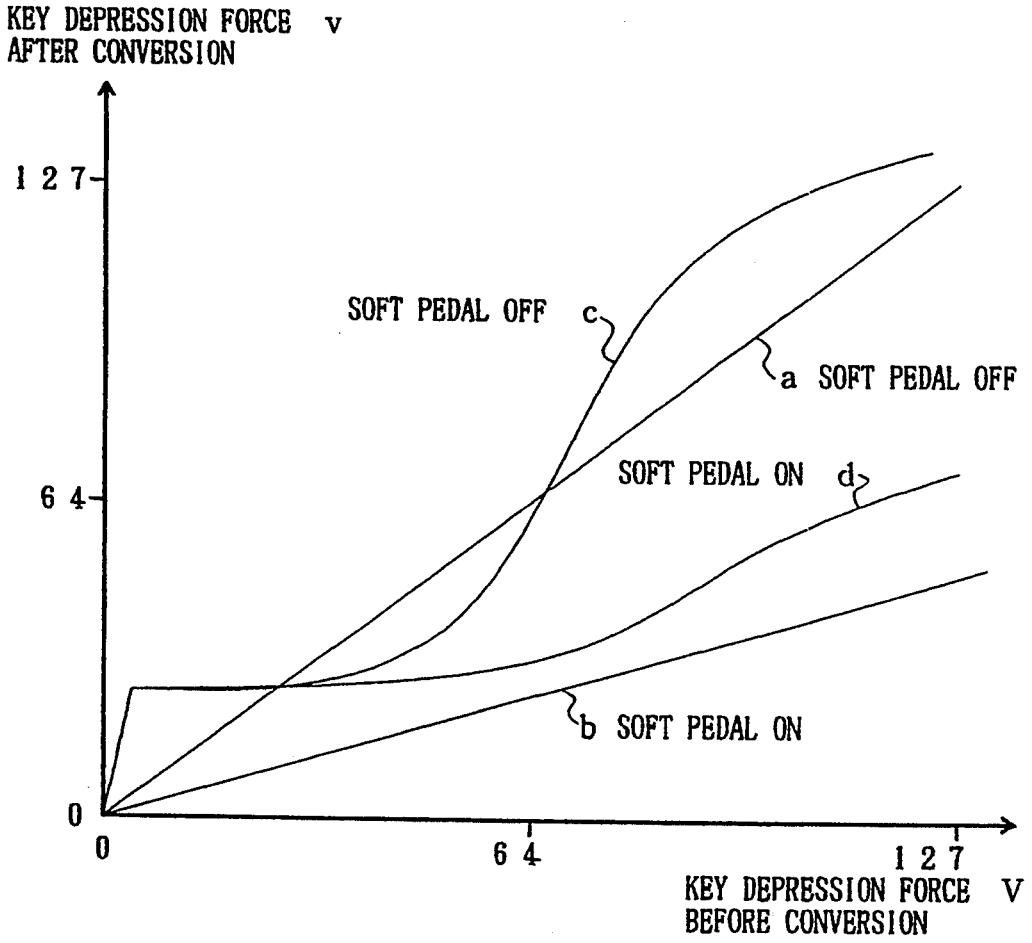
FIG. 9 is a graph for explaining the conversion characteristics of the conversion tables that are used in the embodiment of an apparatus for automatic playing of a piano according to the present invention.

As shown in FIG. 9, there are two soft pedal conversion table types. One type (represented by characteristic line "a") is used to convert key depression force data to obtain values that correspond to the soft pedal OFF state, and the other type (represented by characteristic line "b") is used to convert key depression force data to obtain values that correspond to the soft pedal ON state. The horizontal graph line in FIG. 9 represents key depression force V before conversion and the vertical line represents key depression force v after conversion.

Characteristic line "a" represents a conversion rate of "1" (rate of increase in key depression force v after conversion with respect to the increase in key depression force V before conversion). This indicates that there is no substantial conversion and that music is played normally, as it would be were no conversion of key depression force data performed.

Characteristic line "b" represents a conversion rate that is smaller than "1". When the key depression force V in the event information is used to perform a soft pedal table lookup, the key depression force v obtained for a soft pedal ON state is smaller than that obtained for a soft pedal OFF state.

A time counter 46 in FIG. 3 increments a count value at a predetermined speed in response to a clock signal from a clock generator 47. The contents held by the time counter 36 are read by the CPU 40 and are used for determining tone-ON timing.

The CPU 40, the ROM 41, the RAM 42, the input/output interface 43, the solenoid driver 44, the conversion tables 45, and the time counter 46 are mutually connected by the system bus 50.

The operation of a self-playing piano of the embodiment will now be explained.

When the start switch (not shown) on the operation switch section 30 is depressed, the switch state is sent via the cable 12 and the input/output interface 43 to the CPU 40. Upon receipt of that data, the CPU 40 reads one event information group of play data (see FIG. 4A) from the storage device 32 and extracts the time information included in that event information.

Then, the CPU 40 reads the count value held by the time counter 46, and compares that count value with the extracted time information. If the comparison result is "count value≧time information", the event information is executed.

After execution of the event is completed, another event information group is read from the storage device 32, and the described process is repeated to thereby play music.

The above described operation is an automatic playing method that uses play data that is previously stored in a storage device. Another automatic playing method that can be used is the real time execution of play data received from an external device. Since event information that is executed in real time does not include time information, examination of the event execution timing is not necessary.

Figure 5:
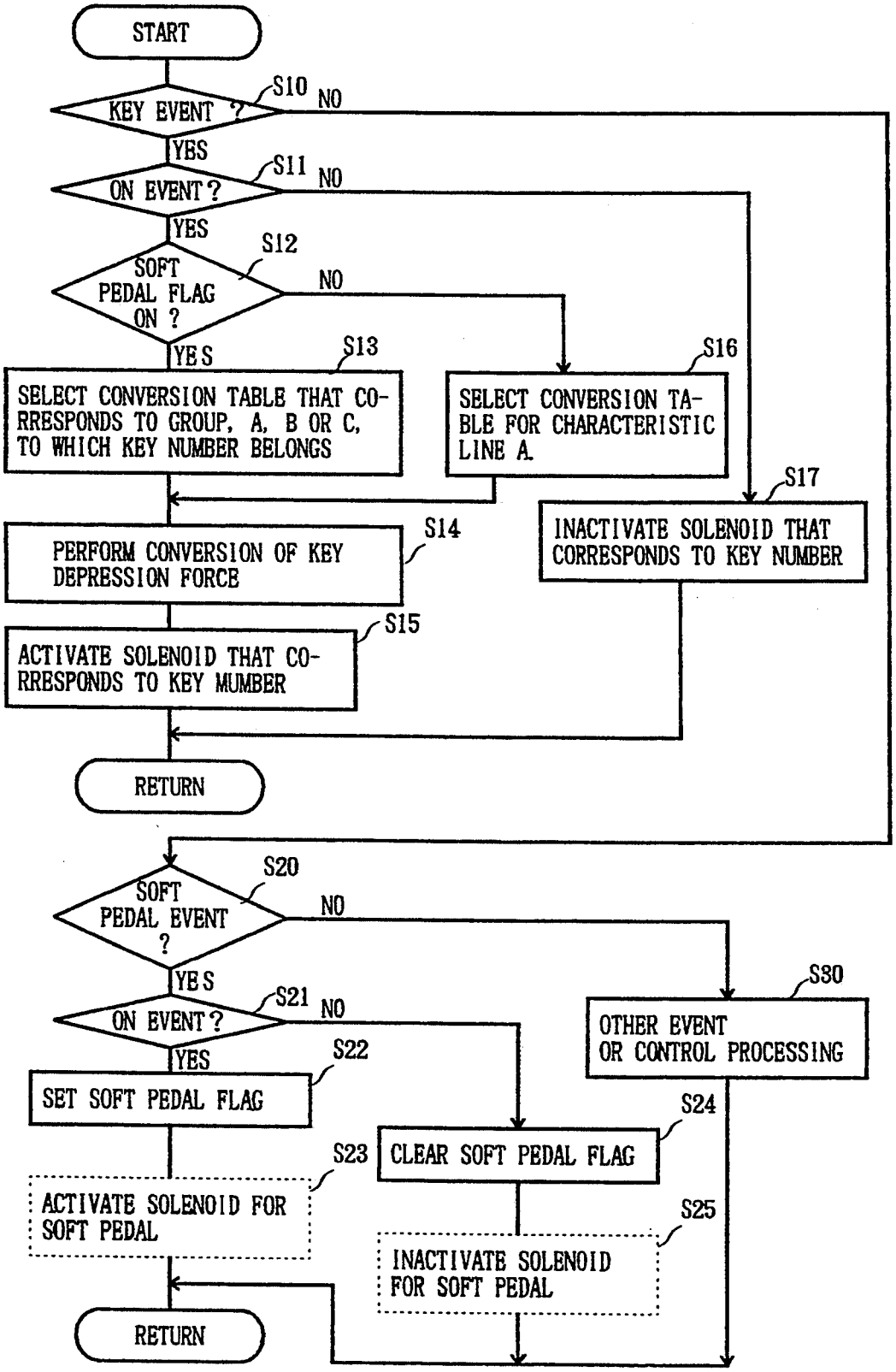
FIG. 5 is a flowchart of the processing performed in the embodiment of a self-playing piano according to the present invention.

The sequential execution of the event information is depicted by the flowchart in FIG. 5.

First, a check is performed to determine whether or not event information read from the storage device 32 is key event information (step S10). This determination is made by ascertaining whether the identification symbol for the event information is "$8^*_H$" or "$9^*_H$".

When the event information is for a key event, a check is performed to determine whether or not the event information is ON event information (step S11). In other words, a check is performed to determine whether the key identification symbol is "$9^*_H$", indicating note-ON, or "$8^*_H$", indicating note-OFF.

When the key event information is ON event information, a check is performed to determine whether a soft pedal flag is in the ON state (step S12). If the soft pedal flag is in the ON state, a conversion table is selected that corresponds to the group (A, B, or C) to which the numerically designated key in the event information belongs (step S13). If the key number belongs to group B, a conversion table for characteristic line "c" is selected.

If the soft pedal flag is not in the ON state, a conversion table for characteristic line "a", which indicates that there is no substantial conversion, is selected (step S16).

Sequentially, key depression force data are converted by referring to a selected conversion table (step S14). In other words, key depression force V in the event information is used to perform a table lookup of the conversion table 45 to obtain new key depression force v.

Based on the converted key depression force v, the key solenoid $14_1$ to $14_n$ that is paired with the key 18 that is represented by the key number in the event information is activated (step S15). More specifically, the converted key depression force v is transmitted to the solenoid driver 44, which in turn activates one of the key solenoids $14_1$ to $14_n$ using the average power in consonance with the key depression force v. As a result, the key 18 is depressed at the key depression force obtained by referring to the characteristic line in the selected conversion table 45, and musical tones are produced.

If, at step S11, the key event information is not ON event information, one of the key solenoids $14_1$ to $14_n$, which corresponds to the key number in the event information, is inactivated (step S17). The key 18 is therefore released and returns to its original position, and the production of a musical tone is halted.

If, at step S10, the event information is not key event information, a check is performed to determine whether it is soft pedal event information (step S20). This determination is made by examining the identification symbol and the key number in the event information, i.e., checking to determine whether the identification symbol is "$B0_H$" and the key number is "$43_H$".

When the event information is soft pedal event information, a check is performed to determine whether it is ON event information (step S21). This determination is made by examining the key depression data in the event information. If the value of the data is "$0_H$", the soft pedal information is OFF event information, whereas if it is a value of from "$1_H$ to $7F_H$" it is ON event information.

When the soft pedal information is ON event information, a soft pedal flag is set (step S22). To perform tone generation, a conversion table for characteristic line "b", "c", or "d", which corresponds to the key number, is selected, and key depression force data is converted. The process for a soft pedal event is then terminated.

For an automatic playing apparatus that has a soft pedal mechanism, a solenoid for the soft pedal is activated (step S23). As a satisfactory soft sound effect can be obtained by using the converted key depression force data, however, the process at step S23 can be eliminated. An automatic playing apparatus in this embodiment that does not have a soft pedal-mechanism does not need the process at step S23.

If, at step S21, the soft pedal event information is not ON event information, the soft pedal flag is cleared (step S24). To perform tone generation, a conversion table for characteristic line "a" is selected and the key depression force data is converted. The process for a soft pedal event is then terminated.

For an automatic playing apparatus with a soft pedal mechanism, sequentially the soft pedal solenoid is inactivated (step S25) and the soft pedal is returned to its normal state. The process at step 25 can be eliminated when the soft pedal is not activated at step S23. For an automatic playing apparatus in this embodiment without a soft pedal, the process at step 25 is also eliminated.

If, at step S20, the event information is not soft pedal event information, an "other" event or control process is performed (step S30).

If, for example, the identification symbol is "$B0_H$", the key number is "$40_H$" and the key depression force has a value of from "$1_H$" to "$127_H$", the information is loud pedal ON event information. The loud pedal solenoid 15 is activated and the loud pedal 22 is depressed.

If the identification symbol is "$B0_H$", the key number is "$40_H$" and the key depression force value is "$0_H$", the information is loud pedal OFF event information. The loud pedal solenoid 15 is inactivated, and the loud pedal 22 is released and returns to its normal state.

If the identification symbol is "$B0_H$" and the key number is "$7B_H$", all-note-OFF processing is performed. In addition to this processing, a number of processes are performed in consonance with the key number in the control information.

As described above, according to this embodiment, multiple conversion tables that hold conversion characteristics for corresponding key ranges are prepared and are employed for conversion of key depression force data. When soft pedal event information is included in given play data, a soft pedal flag is set to indicate that the soft pedal of a self-playing piano is in an ON or OFF state.

When key event information is received and the ON state of the soft pedal is held by the soft pedal flag, a conversion table that corresponds to a key range for a key identified by a key number in event information is selected. By referring to the selected conversion table, key depression force data are converted and new key depression force data are obtained. Thus, the depression of a key is based on the obtained key depression force data.

Consequently, a soft sound effect that is equivalent to one obtained by the depression of a soft pedal can be provided by the above described simple process, i.e., conversion of the key depression force data included in key event information.

Since key depression force data is converted in consonance with the key range to which a key specified by number in the event information belongs, a soft sound effect is obtained that is equivalent to one produced following the depression of the soft pedal of a grand piano. If this method is used with an upright piano, the quality of the sounds it produces will equal those produced by a grand piano.

In this embodiment, even in a soft pedal OFF state, a conversion table for characteristic line "a" is employed to convert key depression force data at a conversion rate of "1". The apparatus can also be designed to perform no conversion in the soft pedal OFF state. In this case, the process at step S16 in FIG. 5 is eliminated.

The operation of an apparatus for automatic playing of a piano with the arrangement shown in FIG. 3 will now be explained.

When the start switch (not shown) on the operation switch section 30 is depressed, the switch state is sent via the input/output interface 43 to the CPU 40. Upon receipt of that data, the CPU 40 reads one event information group of play data (see FIG. 4A) from the storage device 32 and extracts the time information that is included in that event information.

Then, the CPU 40 reads the count value held by the time counter 46 and compares that count value with the extracted time information. When the comparison result is "count value≧time information", the CPU 40 executes the event information.

After execution of the event is completed, another event information group is read from the storage device 32, and the described process is repeated to thereby play music.

The above described operation is performed by an automatic playing method that uses play data that has been previously stored in the storage device 32. Another automatic playing method that can be used is the real time execution of play data that is received from an external device. Since event information that is executed in real time does not include time information, examination of the event execution timing is not necessary.

Figure 7:
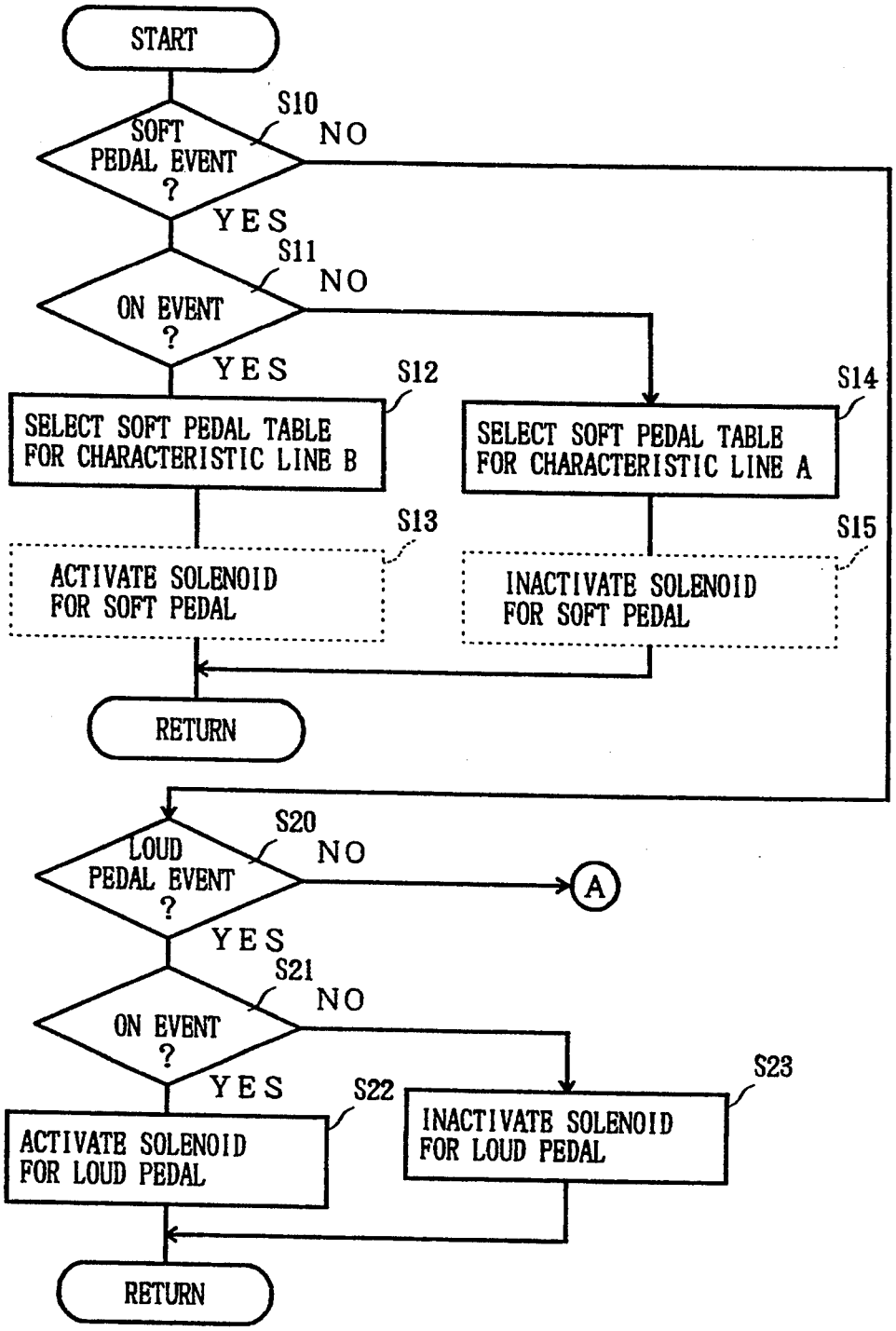
FIG. 7 is a flowchart of the processing performed in the embodiment of an apparatus for automatic playing of a piano according to the present invention.
Figure 8:
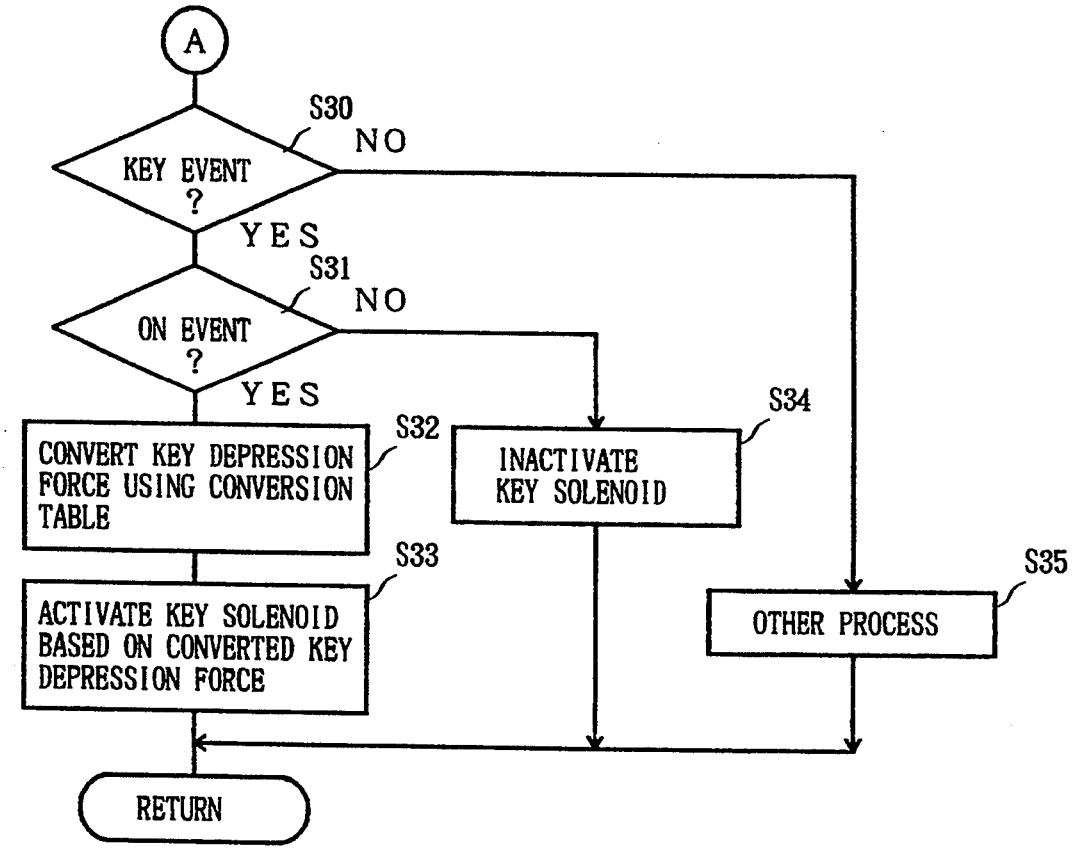
FIG. 8 is a flowchart of the processing performed in the embodiment of an apparatus for automatic playing of a piano according to the present invention.

The sequential execution of the event information is depicted by the flowchart in FIGS. 7 and 8.

First, a check is performed to determine whether event information, from the storage device 32, that is transmitted via the input/output interface 43 is soft pedal event information (step S10). This determination is made by ascertaining whether the identification symbol for that event information is "$B0_H$" and whether the key number for the event information is "$43_H$".

When the event information is for a soft pedal event, a check is performed to determine whether the event information is ON event information (step S11). In other words, a check is performed to determine whether the key depression force value for the event information is "0". A key depression force value of "0" indicates an OFF event, while key depression force values of "1" to "127" indicate ON events.

If the soft pedal event information is ON event information, a soft pedal table for characteristic line "b" is selected (step S12). Then, data indicating that the conversion table 45 for characteristic line "b" is being used to convert key depression force data is stored in a predetermined area in the RAM 42. For tone generation, the conversion table 45 for characteristic line "b" is employed to convert key depression force data. The process for a soft pedal event is then terminated.

When an automatic playing apparatus has a soft pedal mechanism, the solenoid for the soft pedal is activated (step S13). As a satisfactory soft sound effect can be obtained by using converted key depression force data, however, the process at step S13 can be eliminated. In this embodiment, the process at step S13 is also eliminated for an automatic playing apparatus that does not have a soft pedal mechanism.

If, at step S11, the soft pedal event information is not ON event information, the soft pedal table for characteristic line "a" is selected (step S14). Then, data indicating that characteristic line "a" is being used for the conversion of key depression force data are stored in a predetermined area in the RAM 42. For tone generation, the conversion table 45 for characteristic line "a" is employed to convert key depression force. The process for a soft pedal event is then terminated.

When an automatic playing apparatus has a soft pedal mechanism, the solenoid for the soft pedal is inactivated (step S15) and the soft pedal is returned to its original position. If activation of the solenoid at step S13 is eliminated, however, the process at step S15 is not performed. In this embodiment, the process at step S15 is also eliminated for an automatic playing apparatus that does not have a soft pedal mechanism.

If, at step S10, the event information is not soft pedal event information, a check is performed to determine whether it is loud pedal event information (step S20). This determination is made by examining the identification symbol and the key number in the event information to determine whether the identification symbol is "$B0_H$" and whether the key number is "$40_H$".

When the event information is loud pedal event information, a check is performed to determine whether it is ON event information (step S21). This determination is made in the same manner as in step S11.

When the loud pedal information is ON event information, the solenoid for the loud pedal 22 is activated (step S22). While the solenoid that is coupled to the loud pedal 22 is active, the loud pedal 22 is depressed.

If, at step S21, the loud pedal event information is not ON event information, the solenoid for the loud pedal 22 is inactivated (step S23). When the solenoid that is coupled to the loud pedal 22 is inactivated, the loud pedal 22 is released and returns to its original position.

If, at step S20, the event information is not loud pedal event information, a check is performed to determine whether the event information is key event information (step S30). This determination is made by examining the identification symbol for the event information.

When it is determined that the event information is key event information, a check is then performed to determine whether the information is ON event information (step S31). This determination is made in the same manner as in step S11.

If the key event information is ON event information, key depression force data are converted by referring to a conversion table 45 (step S32). More specifically, the key depression force V in the event information is used to perform a table lookup of the conversion table 45 to obtain the new key depression force v. The conversion table 45 for characteristic line "a" or "b", which is stored in a predetermined area in the RAM 12, is employed for this conversion.

Subsequently, the key solenoids $14_1$ to $14_n$ are activated in consonance with the converted key depression force data (step S33). In other words, the converted key depression force v is transmitted to the solenoid driver 44, which in turn activates the key solenoids $14_1$ to $14_n$ using the average power that corresponds to the key depression force v. The keys 18 are depressed using normal key depression force when the conversion table 45 for characteristic line "a" is employed for data conversion, or using a reduced key depression force when the conversion table 45 for characteristic line "b" is employed for data conversion, and musical tones are thus produced.

If, at step S31, the key event information is not ON event information, the key solenoids $14_1$ to $14_n$ are inactivated (step S34). When the key solenoids $14_1$ to $14_n$ are inactivated, the keys 18 are released and reset. Tone generation is thereby halted.

If, at step S30, event information is not key event information, an "other" process is performed (step S35). The "other" process may be, for example, a specific process for control information as identified by its identification symbol.

As described above, in addition to key event information, in this embodiment soft pedal event information is previously stored as play data. When soft pedal event information is read during automatic playing, data indicating whether the soft pedal of the automatic playing apparatus is ON or OFF is stored in a predetermined area in the RAM 42.

Under these conditions, when key event information is read while the stored state of the soft pedal is ON, the key depression force data in the event information are converted according to characteristic line "b", and the converted key depression force data are utilized for key depression.

Thus, through a simple process, i.e., conversion of the key depression force data that is included in key event information, a soft sound effect that is equivalent to one produced by physically depressing a soft pedal can be obtained. Further, a distinct soft sound effect can be produced by appropriate control of the conversion parameters for key depression force data. If this method is used with an upright piano, the quality of the produced sound is as good as that produced by a grand piano.

In the above described embodiment, independent soft pedal tables and characteristic conversion tables are provided. Multiple types of these conversion tables can be replaced by a single conversion table that holds characteristics that correspond to those in the replaced tables. As shown in FIG. 9, when using such a conversion table, characteristic line "c" is employed when the soft pedal is OFF, and characteristic line "d" is employed when the soft pedal is ON.

As described above in detail, in a self-playing piano and an apparatus for automatic playing of a piano, a soft sound effect is produced by controlling key depression force data, not by physically depressing a soft pedal. As a soft pedal mechanism is therefore unnecessary, a self-playing piano can be manufactured easily, and at a lower cost.

Although the conversion tables 45 are provided in a separate ROM in the previously described embodiments, the tables 45 may be provided in the ROM 41 where programs and data are stored.

Further, in the embodiments, key depression force data is converted by referring to the conversion tables. Key depression force can also be calculated by using a mathematical function that yields a value that approximates a conversion characteristic. This method can provide the same effect as in the above described embodiments.

As described above, according to the present invention, an upright piano can produce the same soft sound effect as that produced by a grand piano without physically depressing a soft pedal, and it is possible to provide a self-playing piano, and an apparatus for automatic playing of a piano, that distinctly enhance piano sound quality.

What is claimed is:

1. A self-playing piano having keys, which activates operation terminals in consonance with received play data to play music, comprising:

input means for receiving play data, including, at the least, soft pedal event information and key event information;

soft pedal history holding means for, when said soft pedal event information is received from said input means, holding the ON/OFF history of a soft pedal in consonance with said soft pedal event information;

conversion means for, when said key event information is received from said input means and said soft pedal history holding means is holding an ON event for said soft pedal, performing a predetermined conversion of key depression force data that is included in said key event information, said predetermined conversion being dependent on a key which corresponds to said soft pedal ON event; and control means for controlling said operation terminals in consonance with said key depression force data that has been converted by said conversion means.

2. A self-playing piano according to claim 1, further comprising storage means for storing said play data, wherein said play data is read from said storage means by said input means.

3. An apparatus for automatic playing of a piano, which activates operation terminals in consonance with received play data to play music, comprising:

input means for receiving play data, including, at the least, soft pedal event information for instructing an ON/OFF event of a soft pedal, and key event information for instructing the ON/OFF events of keys and for specifying key depression force;

soft pedal history holding means for, when said soft pedal event information is received from said input means, holding the ON/OFF history of said soft pedal in consonance with said soft pedal event information;

conversion means for, when said key event information is received from said input means and said soft pedal history holding means is holding an ON event for said soft pedal, performing a predetermined conversion of said key depression force data that is included in said key event information, said predetermined conversion being dependent on a key which corresponds to said soft pedal ON event; and control means for controlling said operation terminals in consonance with said key depression force data that has been converted by said conversion means.

4. An apparatus for automatic playing of a piano, which activates operation terminals in consonance with received play data to play music, comprising:

storage means for storing play data, including, at the least, soft pedal event information for instructing an ON/OFF event of a soft pedal, and key event information for instructing the ON/OFF events of keys and for specifying key depression force;

soft pedal history holding means for, when said soft pedal event information is read from said storage means, holding the ON/OFF history of said soft pedal in consonance with said soft pedal event information;

conversion means for, when said key event information is read from said storage means and said soft pedal history holding means is holding an ON event for said soft pedal, performing a predetermined conversion of said key depression force data that is included in said key event information, said predetermined conversion being dependent on a key which corresponds to said soft pedal ON event; and control means for controlling said operation terminals in consonance with said key depression force data that has been converted by said conversion means.

* * * * *